US011814845B2

(12) United States Patent
Brochu

(10) Patent No.: US 11,814,845 B2
(45) Date of Patent: Nov. 14, 2023

(54) GUTTER COVER WITH FOLDS AND GUTTER ASSEMBLY INCLUDING THE SAME

(71) Applicant: Stephane Brochu, Lévis (CA)

(72) Inventor: Stephane Brochu, Lévis (CA)

( * ) Notice: Subject to any disclaimer, the term of this patent is extended or adjusted under 35 U.S.C. 154(b) by 169 days.

(21) Appl. No.: 17/473,267

(22) Filed: Sep. 13, 2021

(65) Prior Publication Data

US 2022/0081909 A1 Mar. 17, 2022

Related U.S. Application Data

(60) Provisional application No. 63/078,424, filed on Sep. 15, 2020.

(51) Int. Cl.
*E04D 13/00* (2006.01)
*E04D 13/076* (2006.01)

(52) U.S. Cl.
CPC ..... *E04D 13/0767* (2013.01)

(58) Field of Classification Search
CPC ..... E04D 2013/0413; E04D 13/064; E04D 13/076; E04D 13/0767
See application file for complete search history.

(56) References Cited

U.S. PATENT DOCUMENTS

| | | | | |
|---|---|---|---|---|
| D90,272 | S | 7/1933 | White | |
| 2,277,443 | A | 3/1942 | Livingston | |
| 3,042,742 | A | 7/1962 | Foster | |
| 3,295,803 | A | 1/1967 | Blayden | |
| 3,436,878 | A | 4/1969 | Singer | |
| 4,241,548 | A | 12/1980 | Rowe | |
| 4,808,234 | A | 2/1989 | McKay et al. | |
| 4,820,407 | A | 4/1989 | Lilie | |
| 5,010,696 | A * | 4/1991 | Knittel | E04D 13/076 52/12 |
| 5,406,754 | A | 4/1995 | Cosby | |
| 5,619,825 | A | 4/1997 | Leroney et al. | |
| 5,744,218 | A | 4/1998 | Barnes | |
| 5,906,287 | A | 5/1999 | Kohnen | |
| 6,134,843 | A | 10/2000 | Tregear | |

(Continued)

FOREIGN PATENT DOCUMENTS

| | | | |
|---|---|---|---|
| CA | 2305159 | A1 | 10/2001 |
| CA | 2451186 | A1 | 1/2003 |

(Continued)

*Primary Examiner* — Ryan D Kwiecinski
(74) *Attorney, Agent, or Firm* — Reising Ethington P.C.

(57) ABSTRACT

A gutter cover for covering an open top of a gutter having front, rear and bottom walls defining a gutter channel, the gutter cover comprising: front and rear mounting portions operatively engageable with the front and rear walls of the gutter; a central cover portion extending between the front and rear mounting portions and having a plurality of drainage throughholes defined therein, the central cover portion including at least one fold extending in a lengthwise direction of the gutter cover along a longitudinal fold axis and a plurality of fold openings spaced apart from each other and located along the at least one fold to increase flexibility of the central cover portion along the at least one fold to facilitate bending of the central cover portion along the at least one fold, the fold openings being elongated in shape and extending longitudinally along the longitudinal fold axis.

23 Claims, 3 Drawing Sheets

(56) References Cited

U.S. PATENT DOCUMENTS

| | | | | |
|---|---|---|---|---|
| D460,197 | S | 7/2002 | Stringer | |
| 6,427,388 | B1 | 8/2002 | Brochu | |
| D468,446 | S | 1/2003 | Sender et al. | |
| 6,701,674 | B1 | 3/2004 | Albracht | |
| 6,786,008 | B2 | 9/2004 | Brochu | |
| 6,826,872 | B2 | 12/2004 | Brochu | |
| D523,538 | S | 6/2006 | Brochu | |
| D523,969 | S | 6/2006 | Abruzese et al. | |
| D551,740 | S | 9/2007 | Riley | |
| D558,309 | S | 12/2007 | Gregg | |
| D569,011 | S | 5/2008 | Brochu | |
| 7,624,541 | B2 | 12/2009 | Gentry | |
| 7,658,036 | B2 | 2/2010 | Banks et al. | |
| 7,765,743 | B2 | 8/2010 | Guilford | |
| 7,908,797 | B2 | 3/2011 | Graves | |
| 7,913,458 | B2 * | 3/2011 | Higginbotham | E03F 1/00 52/12 |
| 8,037,641 | B2 | 10/2011 | Gerig | |
| D651,292 | S | 12/2011 | Geers | |
| 8,191,315 | B1 | 6/2012 | Brochu | |
| 8,322,082 | B2 * | 12/2012 | Neumann | E04D 13/076 52/12 |
| 8,347,557 | B2 | 1/2013 | Minor, Sr. et al. | |
| 8,375,644 | B2 | 2/2013 | Robins | |
| D677,405 | S | 3/2013 | Landis | |
| 8,434,269 | B1 * | 5/2013 | Brochu | E04D 13/076 52/12 |
| 8,479,454 | B2 | 7/2013 | Lenney et al. | |
| 8,635,811 | B2 | 1/2014 | Horton | |
| 8,650,803 | B2 * | 2/2014 | Robins | E04D 13/076 52/12 |
| 8,776,444 | B2 | 7/2014 | Beck et al. | |
| D719,648 | S | 12/2014 | Moody et al. | |
| D721,826 | S | 1/2015 | Ryan | |
| D723,671 | S | 3/2015 | Brochu | |
| 9,010,029 | B2 | 4/2015 | Higginbotham | |
| 9,010,030 | B2 | 4/2015 | Davis | |
| D736,900 | S | 8/2015 | Frelier | |
| 9,127,463 | B1 | 9/2015 | Feldhaus | |
| 9,163,406 | B1 | 10/2015 | Ealer, Sr. | |
| D742,541 | S | 11/2015 | Ryan | |
| D770,603 | S | 11/2016 | Fryml | |
| D782,624 | S | 3/2017 | Haendel | |
| D792,985 | S | 7/2017 | Jones | |
| D796,067 | S | 8/2017 | Landis et al. | |
| 10,100,522 | B2 | 10/2018 | Beck et al. | |
| 10,519,668 | B1 * | 12/2019 | Bachman | E04D 13/076 |
| 10,604,936 | B2 * | 3/2020 | Brochu | E04D 13/068 |
| 10,676,932 | B2 * | 6/2020 | Miller, Jr. | E04D 13/076 |
| 11,060,293 | B2 | 7/2021 | Graves | |
| 11,268,282 | B1 * | 3/2022 | Kroneberger | E04D 13/068 |
| 11,391,047 | B2 * | 7/2022 | Lenney | E04D 13/064 |
| 2003/0110712 | A1 | 6/2003 | Brochu | |
| 2004/0060244 | A1 | 4/2004 | Brochu | |
| 2004/0118052 | A1 | 6/2004 | Brochu | |
| 2004/0182014 | A1 | 9/2004 | Brochu | |
| 2004/0244302 | A1 | 12/2004 | Neumann | |
| 2005/0028452 | A1 | 2/2005 | Brochu | |
| 2005/0115160 | A1 | 6/2005 | Brocu | |
| 2005/0193642 | A1 | 9/2005 | Brochu et al. | |
| 2005/0193671 | A1 | 9/2005 | Brochu et al. | |
| 2005/0223657 | A1 | 10/2005 | Brochu et al. | |
| 2005/0279036 | A1 | 12/2005 | Brochu | |
| 2006/0037254 | A1 | 2/2006 | Brochu | |
| 2006/0037255 | A1 | 2/2006 | Brochu | |
| 2006/0107603 | A1 * | 5/2006 | Brownridge | E04D 13/076 52/11 |
| 2006/0123710 | A1 | 6/2006 | Lenney et al. | |
| 2006/0283097 | A1 | 12/2006 | Gregg | |
| 2007/0167130 | A1 | 7/2007 | Brochu | |
| 2007/0169423 | A1 | 7/2007 | Brochu | |
| 2008/0010906 | A1 | 1/2008 | Brochu | |
| 2008/0163561 | A1 | 7/2008 | Lenney et al. | |
| 2008/0190039 | A1 | 8/2008 | Brochu | |
| 2008/0190070 | A1 | 8/2008 | Duncan et al. | |
| 2008/0289263 | A1 | 11/2008 | Brochu | |
| 2009/0013612 | A1 | 1/2009 | Brochu | |
| 2009/0056234 | A1 | 3/2009 | Brochu | |
| 2009/0108144 | A1 | 4/2009 | Brochu | |
| 2010/0287846 | A1 | 11/2010 | Lenney | |
| 2011/0056145 | A1 | 3/2011 | Lenney | |
| 2011/0067317 | A1 | 3/2011 | Hedrick | |
| 2011/0067318 | A1 | 3/2011 | Lenney et al. | |
| 2011/0138698 | A1 | 6/2011 | Neumann | |
| 2011/0265391 | A1 * | 11/2011 | Robins | E04D 13/076 52/12 |
| 2012/0151849 | A1 | 6/2012 | Brochu | |
| 2013/0091780 | A1 | 4/2013 | Robins | |
| 2014/0069028 | A1 | 3/2014 | Lenney | |
| 2014/0215929 | A1 | 8/2014 | Lenney | |
| 2015/0020462 | A1 | 1/2015 | Iannelli | |
| 2015/0040488 | A1 | 2/2015 | Lenney | |
| 2015/0143756 | A1 | 5/2015 | Higginbotham | |
| 2015/0225959 | A1 | 8/2015 | Lenney | |
| 2015/0330085 | A1 | 11/2015 | Iannelli | |
| 2016/0060870 | A1 | 3/2016 | Martin | |
| 2016/0369512 | A1 | 12/2016 | Lenney | |
| 2017/0204611 | A1 * | 7/2017 | Brochu | E04D 13/076 |
| 2018/0030733 | A1 | 2/2018 | Brochu | |
| 2019/0218782 | A1 * | 7/2019 | Miller, Jr. | E04D 13/076 |
| 2020/0157820 | A1 | 5/2020 | Lenney | |
| 2021/0285224 | A1 | 9/2021 | Graves | |
| 2022/0081909 | A1 * | 3/2022 | Brochu | E04D 13/0767 |
| 2023/0024591 | A1 * | 1/2023 | Bolon | E04D 13/076 |

FOREIGN PATENT DOCUMENTS

| | | | | |
|---|---|---|---|---|
| CA | 2405756 | A1 | 3/2004 | |
| CA | 2458005 | A1 | 8/2005 | |
| CA | 2460429 | A1 | 9/2005 | |
| CA | 2541186 | A1 | 7/2007 | |
| CA | 2593808 | A1 | 1/2009 | |
| CA | 2608530 | A1 | 4/2009 | |
| CA | 2747704 | A1 | 7/2009 | |
| CA | 2723499 | A1 * | 3/2011 | E04D 13/076 |
| CA | 2723499 | A1 | 3/2011 | |
| CA | 2727844 | A1 | 7/2012 | |
| CA | 2747513 | A1 | 1/2013 | |
| CA | 2783834 | A1 | 8/2013 | |
| CA | 2783834 | A1 * | 8/2013 | E04D 13/076 |
| CA | 2775864 | A1 | 11/2013 | |
| CA | 2933239 | A1 | 7/2015 | |
| CA | 2863023 | A1 | 3/2016 | |
| CA | 166698 | S | 8/2016 | |
| CA | 169577 | S | 2/2017 | |
| CA | 2907280 | A1 | 2/2017 | |
| CA | 2955268 | A1 | 7/2017 | |
| CA | 2919709 | A1 | 8/2017 | |
| CA | 2963962 | A1 | 10/2017 | |
| CA | 2931540 | A1 | 11/2017 | |
| CA | 175672 | S | 4/2018 | |
| CA | 2985004 | A1 | 5/2018 | |
| CA | 3016527 | A1 | 3/2019 | |
| CA | 3023339 | A1 | 5/2019 | |
| CA | 3045555 | A1 | 12/2020 | |
| EP | 1449980 | A1 | 8/2004 | |
| EP | 1627974 | A2 | 2/2006 | |
| EP | 2159342 | A1 | 3/2010 | |
| EP | 2177685 | A1 | 4/2010 | |
| EP | 2251500 | A1 | 11/2010 | |
| GB | 2481033 | A | 12/2011 | |
| GB | 2493284 | A | 1/2013 | |
| WO | 2007100320 | A1 | 9/2007 | |
| WO | 2008134845 | A1 | 11/2008 | |
| WO | 2009150174 | A1 | 12/2009 | |

* cited by examiner 104
454
450
456
602
452
756
754
700b
750
760
752
700a
56
50
10
450
100
700
60
52
300
750
404
406

58
402
600
400
106
200
800
102
54

GUTTER COVER WITH FOLDS AND GUTTER ASSEMBLY INCLUDING THE SAME

CROSS-REFERENCE TO RELATED APPLICATION(S)

The present application claims priority from U.S. Provisional Patent Application No. 63/078,424, filed on Sep. 15, 2020, the entire specification of which is incorporated herein by reference.

TECHNICAL FIELD

The technical field generally relates to gutter covers, and more precisely to gutter covers including at least one fold. The technical field also relates to gutter assemblies comprising a gutter and a gutter cover, and to methods for forming gutter covers.

BACKGROUND

Rain gutters are useful to collect rainwater that runs off the roof of a house or of a building and to route collected rainwater away from the foundation to a proper drainage area in order to avoid damages to the foundation, the soffit, the windows and/or the doors, for instance. Rain gutters generally include a trough channeling the rainwater to a downpipe or downspout, the trough being affixed to a supporting structure of the house or building such as the fascia board.

Leaves and debris may accumulate within the trough of the gutter, which can prevent the rainwater from flowing through the trough. Gutter guards or gutter covers are used to protect the gutter by preventing leaves and debris from enter the trough of the gutter while still permitting rainwater to enter the trough.

SUMMARY

According to one aspect, there is provided a gutter cover for covering an open top of a gutter having a front wall, a rear wall and a bottom wall defining a gutter channel, the gutter cover comprising: a front mounting portion operatively engageable with the front wall of the gutter; a rear mounting portion operatively engageable with the rear wall of the gutter; a central cover portion extending between the front and rear mounting portions, the central cover portion having a plurality of drainage throughholes defined therein for allowing liquids to enter the gutter channel, the central cover portion including at least one fold extending in a lengthwise direction of the gutter cover along a longitudinal fold axis and a plurality of fold openings spaced apart from each other and located along the at least one fold to increase flexibility of the central cover portion along the at least one fold in order to facilitate bending of the central cover portion along the at least one fold, the fold openings being elongated in shape and extending longitudinally along the longitudinal fold axis.

In at least one embodiment, the fold openings are substantially evenly spaced apart from each other.

In at least one embodiment, the fold openings are spaced from each other by a distance of between about ⅛ inch and about 2 inches.

In at least one embodiment, the fold openings are spaced from each other by a distance of about ½ inch.

In at least one embodiment, all the fold openings are similarly sized and shaped.

In at least one embodiment, the fold openings are shaped differently from the drainage throughholes.

In at least one embodiment, each fold opening includes an elongated slit having a pair of side edges which are substantially straight and extend parallel to each other.

In at least one embodiment, the pair of side edges are substantially parallel to the longitudinal fold axis.

In at least one embodiment, each fold opening is substantially rectangular in shape.

In at least one embodiment, each fold opening has a length extending along the longitudinal fold axis and a width extending transversely relative to the longitudinal fold axis, the length being substantially greater than the width.

In at least one embodiment, the length of each fold opening is between about 1/16 inch and about 7 inches.

In at least one embodiment, the length of each fold opening is about ¼ inch.

In at least one embodiment, the width of each fold opening is between about 0.01 inch and about ¼ inch.

In at least one embodiment, the width of each fold opening is about 0.025 inch.

In at least one embodiment, the fold openings extend over between about 5% and about 90% of a length of the gutter cover.

In at least one embodiment, the fold openings extend over between about 25% and about 50% of the length of the gutter cover.

In at least one embodiment, the fold openings extend over between about 33% of the length of the gutter cover.

In at least one embodiment, the central portion includes a plurality of cover sections extending in the lengthwise direction and extending non-parallel to each other.

In at least one embodiment, the plurality of cover sections includes a front cover section located adjacent the front mounting portion and a rear cover section extending in a widthwise direction relative to the gutter between the front cover section and the rear mounting portion.

In at least one embodiment, the at least one fold includes a section connecting fold extending between the front and rear cover sections.

In at least one embodiment, when the gutter cover is installed on the gutter, the section connecting fold extends downwardly and towards the gutter.

In at least one embodiment, one of the front and rear cover sections is substantially curved.

In at least one embodiment, the rear cover section is substantially curved.

In at least one embodiment, the rear cover section is substantially convexly curved.

In at least one embodiment, the at least one fold includes a plurality of rear section folds defined in the rear cover section.

In at least one embodiment, the rear cover section includes a plurality of planar panels extending in the lengthwise direction, each planar panel being angled relative to adjacent planar panels, and further wherein the rear section folds extend between the planar panels.

In at least one embodiment, the rear section folds include between 2 and 10 folds. In at least one embodiment, the rear section folds include 5 folds.

In at least one embodiment, each one of the at least one folds has a substantially V-shaped cross-section.

In at least one embodiment, each fold includes a front panel portion located towards the front mounting portion and a rear panel portion located towards the rear mounting portion, the front and rear panel portions being angled relative to each other and meeting each other to form a fold ridge, the fold openings being defined along the fold ridge.

In at least one embodiment, the fold ridge is substantially rounded.

In at least one embodiment, when the gutter cover is installed on the gutter, at least one of the at least one folds extends upwardly and away from the gutter.

In at least one embodiment, when the gutter cover is installed on the gutter, at least one of the at least one folds extends downwardly and towards the gutter.

In at least one embodiment, the front mounting portion, the rear mounting portion and the central cover portion are integrally formed together using a single, continuous sheet of material.

According to another aspect, there is also provided a gutter cover blank sheet for forming a gutter cover, the gutter cover being installable on a gutter having a front wall, a rear wall and a bottom wall defining a gutter channel the gutter cover blank sheet comprising: a front blank sheet portion for forming a front mounting portion operatively engageable with the front wall of the gutter; a rear blank sheet portion for forming a rear mounting portion operatively engageable with the rear wall of the gutter; a central blank sheet portion extending between the front and rear blank sheet portions, the central blank sheet portion including a plurality of drainage throughholes defined therein, the central blank sheet portion being foldable along at least one longitudinal fold axis to define a fold of the gutter cover, the central blank sheet portion further including a plurality of fold openings spaced apart from each other and located along the at least one fold the at least one longitudinal fold axis to facilitate folding the central blank sheet portion along the at least one longitudinal fold axis, the fold openings being elongated in shape and extending longitudinally along the longitudinal fold axis.

According to yet another aspect, there is also provided a method for forming a gutter cover, the method comprising: providing a gutter cover blank sheet as defined above; folding the gutter cover blank sheet along the at least one longitudinal fold axis to form the fold in the gutter cover.

In at least one embodiment, the method further comprises: forming the front mounting portion in the front blank sheet portion.

In at least one embodiment, the method further comprises: forming the rear mounting portion in the rear blank sheet portion.

In at least one embodiment, the method further comprises, before providing the gutter cover blank sheet: cutting the plurality of fold openings in the central blank sheet portion.

According to yet another aspect, there is also provided a gutter assembly comprising: a gutter having a front wall, a rear wall and a bottom wall defining a gutter channel having an open top; a gutter cover for covering the open top of the gutter, the gutter cover comprising: a front mounting portion operatively engageable with the front wall of the gutter; a rear mounting portion operatively engageable with the rear wall of the gutter; a central cover portion extending between the front and rear mounting portions, the central cover portion having a plurality of drainage throughholes defined therein for allowing liquids to enter the gutter channel, the central cover portion including at least one fold extending in a lengthwise direction of the gutter cover along a longitudinal fold axis and a plurality of fold openings spaced apart from each other and located along the at least one fold to increase flexibility of the central cover portion along the at least one fold in order to facilitate bending of the central cover portion along the at least one fold, the fold openings being elongated in shape and extending longitudinally along the longitudinal fold axis.

In at least one embodiment, the fold openings are substantially evenly spaced apart from each other.

In at least one embodiment, the fold openings are spaced from each other by a distance of between about ⅛ inch and about 2 inches.

In at least one embodiment, the fold openings are spaced from each other by a distance of about ½ inch.

In at least one embodiment, all the fold openings are similarly sized and shaped.

In at least one embodiment, the fold openings are shaped differently from the drainage throughholes.

In at least one embodiment, each fold opening includes an elongated slit having a pair of side edges which are substantially straight and extend parallel to each other.

In at least one embodiment, the pair of side edges are substantially parallel to the longitudinal fold axis.

In at least one embodiment, each fold opening is substantially rectangular in shape.

In at least one embodiment, each fold opening has a length extending along the longitudinal fold axis and a width extending transversely relative to the longitudinal fold axis, the length being substantially greater than the width.

In at least one embodiment, the length of each fold opening is between about 1/16 inch and about 7 inches.

In at least one embodiment, the length of each fold opening is about ¼ inch.

In at least one embodiment, the width of each fold opening is between about 0.01 inch and about ¼ inch.

In at least one embodiment, the width of each fold opening is about 0.025 inch.

In at least one embodiment, the fold openings extend over between about 5% and about 90% of a length of the gutter cover.

In at least one embodiment, the fold openings extend over between about 25% and about 50% of the length of the gutter cover.

In at least one embodiment, the fold openings extend over between about 33% of the length of the gutter cover.

In at least one embodiment, the central portion includes a plurality of cover sections extending in the lengthwise direction and extending non-parallel to each other.

In at least one embodiment, the plurality of cover sections includes a front cover section located adjacent the front mounting portion and a rear cover section extending in a widthwise direction relative to the gutter between the front cover section and the rear mounting portion.

In at least one embodiment, the at least one fold includes a section connecting fold extending between the front and rear cover sections.

In at least one embodiment, when the gutter cover is installed on the gutter, the section connecting fold extends downwardly and towards the gutter.

In at least one embodiment, one of the front and rear cover sections is substantially curved.

In at least one embodiment, the rear cover section is substantially curved.

In at least one embodiment, the rear cover section is substantially convexly curved.

In at least one embodiment, the at least one fold includes a plurality of rear section folds defined in the rear cover section.

In at least one embodiment, the rear cover section includes a plurality of planar panels extending in the lengthwise direction, each planar panel being angled relative to adjacent planar panels, and further wherein the rear section folds extend between the planar panels.

In at least one embodiment, the rear section folds include between 2 and 10 folds. In at least one embodiment, the rear section folds include 5 folds.

In at least one embodiment, each one of the at least one folds has a substantially V-shaped cross-section.

In at least one embodiment, each fold includes a front panel portion located towards the front mounting portion and a rear panel portion located towards the rear mounting portion, the front and rear panel portions being angled relative to each other and meeting each other to form a fold ridge, the fold openings being defined along the fold ridge.

In at least one embodiment, the fold ridge is substantially rounded.

In at least one embodiment, when the gutter cover is installed on the gutter, at least one of the at least one folds extends upwardly and away from the gutter.

In at least one embodiment, when the gutter cover is installed on the gutter, at least one of the at least one folds extends downwardly and towards the gutter.

In at least one embodiment, the front mounting portion, the rear mounting portion and the central cover portion are integrally formed together using a single, continuous sheet of material.

DETAILED DESCRIPTION

Figure 1:
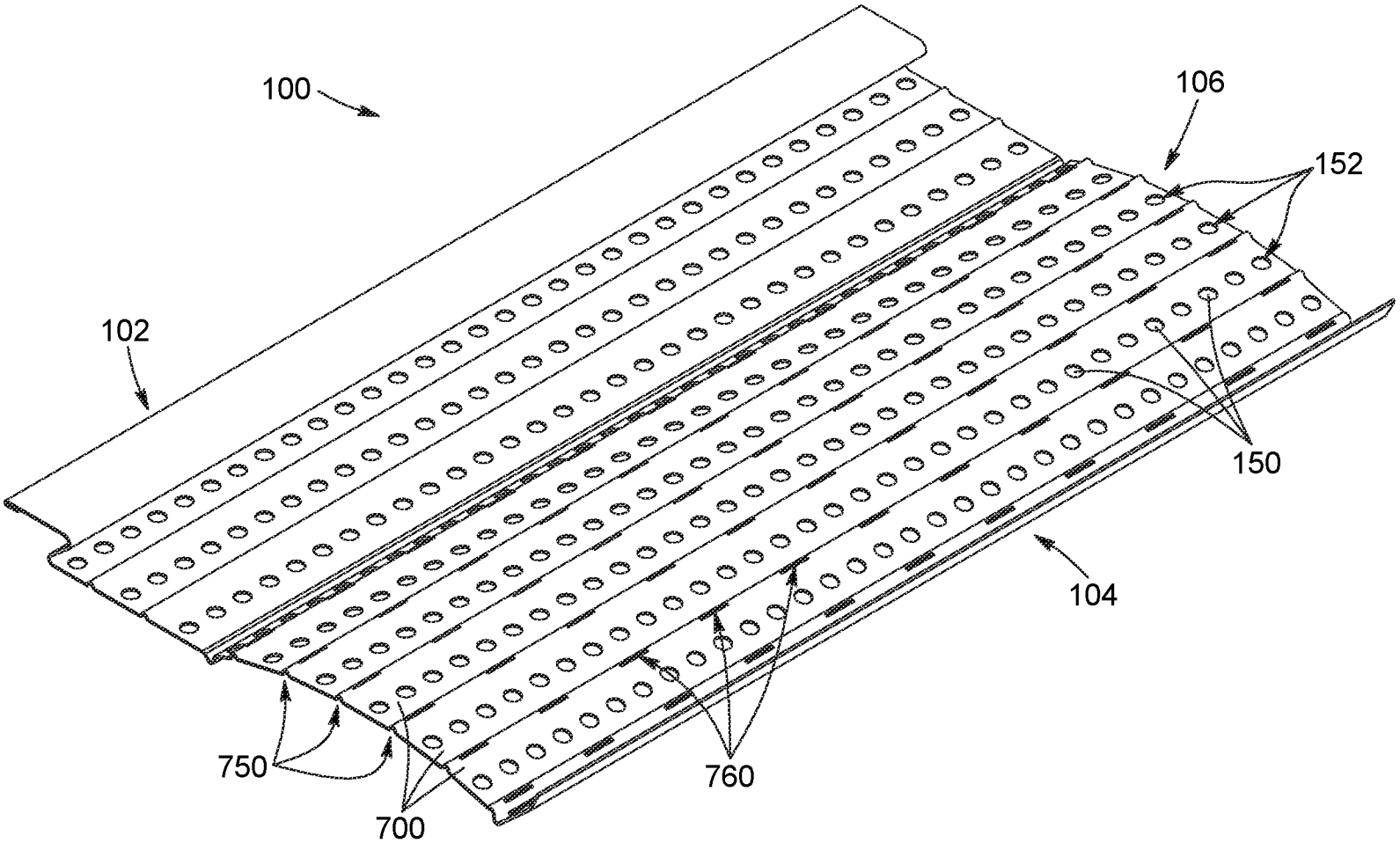
FIG. 1 is a perspective view of a gutter cover for covering an opening of a gutter, in accordance with one embodiment.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "top", "bottom", "forward", "rearward" "left", "right" and the like should, unless otherwise indicated, be taken in the context of the figures and correspond to the position and orientation in the gutter, gutter cover and corresponding parts when being used. Positional descriptions should not be considered limiting.

Referring to FIGS. 1 to 3C, there is shown a gutter cover 100, in accordance with one embodiment. The gutter cover 100 is installable on a gutter 50, shown in FIG. 3A, to form a gutter assembly 10 which can be secured to a supporting surface, such as a wall and/or a roof of a building.

Figures 3A, 3B, 3C:
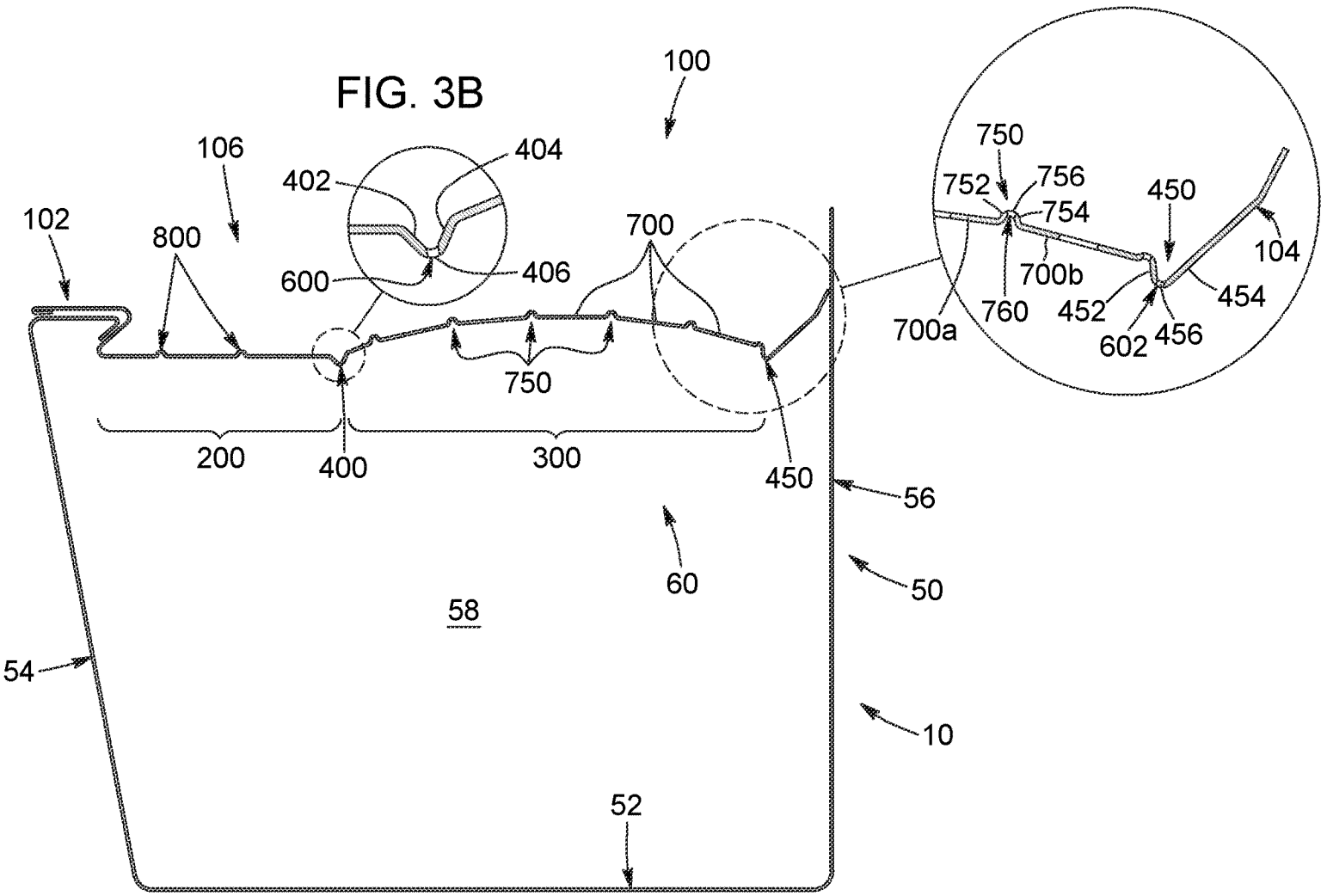
FIG. 3A is a cross-section view of the gutter cover illustrated in FIG. 1.
FIG. 3B is an enlarged portion, taken from area B, of the gutter cover illustrated in FIG. 3A.
FIG. 3C is an enlarged portion, taken from area C, of the gutter cover illustrated in FIG. 3A.

As further shown in FIG. 3A, the gutter 50 includes a bottom wall 52 and front and rear walls 54, 56 extending upwardly from the bottom wall 52 to define a gutter channel 58 having an open top 60.

In the illustrated embodiment, the gutter cover 100 includes a front cover mounting portion 102 configured for engaging the front wall 54 of the gutter 100, a rear cover mounting portion 104 configured for engaging the rear wall 56 of the gutter 50 and a central cover portion 106 extending between the front and rear cover mounting portions 102, 104. As shown in FIG. 3A, when installed on the gutter 50, the gutter cover 100 thereby covers the open top 60 of the gutter 50.

The central cover portion 106 further has a plurality of drainage throughholes 150 defined therein to allow liquid such as rainwater to enter the gutter 50 through its open top 60. In the illustrated embodiment, the drainage throughholes 150 are arranged in a plurality of throughhole rows 152, as shown in FIG. 1, extending in a lengthwise direction relative to the gutter cover 100. Alternatively, the drainage throughholes 150 may instead be arranged according to any other suitable pattern or configuration. Still in the illustrated embodiment, the drainage throughholes 150 are substantially circular but alternatively, the drainage throughholes 150 could have any other suitable shape.

In the illustrated embodiment, the gutter cover 100 is made from a single, continuous sheet of material, and more specifically of metal such as aluminum, an aluminum alloy or the like, which is bent, shaped, perforated and generally configured as desired. In other embodiment, the gutter cover 100 could instead be made of a plurality of separate pieces which could be secured together using known techniques such as welding or the like.

In the illustrated embodiment, the central cover portion 106 does not extend in a continuously planar configuration between the front and rear cover mounting portions 102, 104, but instead includes a plurality of adjacent sections 200, 300 which extend in the lengthwise direction and which extend non-parallel to each other, i.e. that are not coplanar with each other. Specifically, in this embodiment, the central cover portion 106 includes a front cover section 200 which is located adjacent the front cover portion 102 and a rear cover section 300 which extends in a transversal or widthwise direction relative to the gutter cover 100 between the front cover section 200 and the rear cover mounting portion 104. Still in this embodiment, the central cover portion 106 is folded between the front and rear cover sections 200, 300 to define a section connecting fold 400 connecting together the front and rear cover sections 200, 300.

In the illustrated embodiment, the front cover section 200 is substantially planar and the rear cover section 300 is substantially curved. More specifically, the rear cover section 300 is convexly curved such that when the gutter cover 100 is installed on the gutter 50, the rear cover section 300 curves substantially upwardly and away from the gutter 50.

In other embodiments, the central cover portion 106 could be configured differently. For example, the front and rear cover sections 200, 300 could both be planar and could be angled relative to each other. In another embodiment, the front and rear cover sections 200, 300 could both be curved. In yet another embodiment, the central cover portion 106 could include more than two sections, and each section could be planar, curved or have any other suitable configuration.

In the illustrated embodiment, the section connecting fold 400 has a substantially V-shaped cross-section, as best shown in FIG. 3B. Specifically, the section connecting fold 400 includes a front panel portion 402 located towards the front cover section 200 and a rear panel portion 404 located towards the rear cover section 300. The front and rear panel portions 402, 404 are angled relative to each other and meet each other to form a fold ridge 406. The fold ridge 406 is substantially linear and extends in the lengthwise direction relative to the gutter cover 100 along a longitudinal fold axis $L_1$ of the section connecting fold 400. In the illustrated embodiment, the fold ridge 406 is further substantially rounded, but alternatively, the fold ridge 406 could instead be substantially sharp.

Still in the illustrated embodiment, when the gutter cover 100 is installed on the gutter 50, the section connecting fold 400 extends downwardly and towards the gutter 50. In other words, when the gutter cover 100 is installed on the gutter 50, the fold ridge 406 is located below the central cover portion 106.

As best shown in FIGS. 3A and 3C, in the illustrated embodiment, the rear cover mounting portion 104 extends substantially rearwardly and upwardly from the central cover portion 106. When the gutter cover 100 is installed on the gutter 50, the rear mounting portion 104 abuts the gutter's rear wall 56 or a fascia or wall of the building to which the gutter 50 is secured.

In some embodiments, the rear mounting portion 104 may further be secured to the gutter's rear wall 56 or to the fascia or wall of the building using one or more fasteners, not shown. In another embodiment, the rear cover portion 104 could instead have an inverted U-shape and could straddle an upper edge of the gutter's rear wall 56, or have any other suitable configuration.

In the illustrated configuration, the gutter cover 100 is folded between the front and rear cover sections 200, 300 to define a rear connecting fold 450 connecting together the central cover portion 106 and the rear mounting portion 104.

In the illustrated embodiment, the rear connecting fold 450 is substantially similar to the section connecting fold 400. As best shown in FIG. 3C, the rear connecting fold 450 has a substantially V-shaped cross-section and includes a front panel portion 452 located towards the front cover section 200 and a rear panel portion 454 located towards the rear cover section 300. The front and rear panel portions 452, 454 are angled relative to each other and meet each other to form a fold ridge 456. The fold ridge 456 is substantially linear and extends in the lengthwise direction relative to the gutter cover 100 along a longitudinal fold axis $L_2$ of the rear connecting fold 450.

In the illustrated embodiment, when the gutter cover 100 is installed on the gutter 50, the rear connecting fold 450 extends downwardly and towards the gutter 50. In other words, when the gutter cover 100 is installed on the gutter 50, the fold ridge 456 of the rear connecting fold 450 is located below the central cover portion 106.

In the illustrated embodiment, the central cover portion 106 further includes a plurality of fold openings 600, 602 located along the section connecting fold 400 and the rear connecting fold 450. More specifically, the plurality of fold openings 600, 602 includes a plurality of section connecting fold openings 600 defined in the fold ridge 406 of the section connecting fold 400 and a plurality of rear connecting fold openings 602 defined in the fold ridge 456 of the rear connecting fold 450. In other words, the section connecting fold openings 600 are aligned with each other and extend longitudinally along the longitudinal fold axis $L_1$ of the section connecting fold 400, and the rear connecting fold openings 602 are aligned with each other and extend longitudinally along the longitudinal fold axis $L_2$ of the rear connecting fold 450.

It will be appreciated that by providing fold openings 600, 602 along the section connecting fold 400 and the rear connecting folds 450, the amount of material along the folds 400, 450 is reduced, which increases the flexibility of the central cover portion 106 along the folds 400, 450. This may contribute to facilitating the initial forming of the section connecting fold 400 and the rear connecting fold 450 in the central cover portion 100, which includes the bending and shaping a generally planar blank sheet of metal. Moreover, the section connecting fold 400 may also act as a resilient live hinge to allow slight movements of the rear cover section 300 relative to the front cover section 200. This allows the overall width of the gutter cover 100 to be adjusted according to a width of the gutter 50 on which the gutter cover 100 is to be installed.

In the illustrated embodiment, the fold openings 600, 602 are shaped differently from the drainage throughholes 150. Specifically, while the drainage throughholes 150 are substantially circular, the fold openings 600, 602 include a plurality of elongated or oblong slits 650 which extend along the corresponding connecting fold 400, 450, and more specifically along the corresponding longitudinal fold axis $L_1$, $L_2$.

In the illustrated embodiment, all the fold openings 600, 602 are all similarly shaped and sized but alternatively, the fold openings 600, 602 could have various shapes and/or sizes.

Figures 2A, 2B:
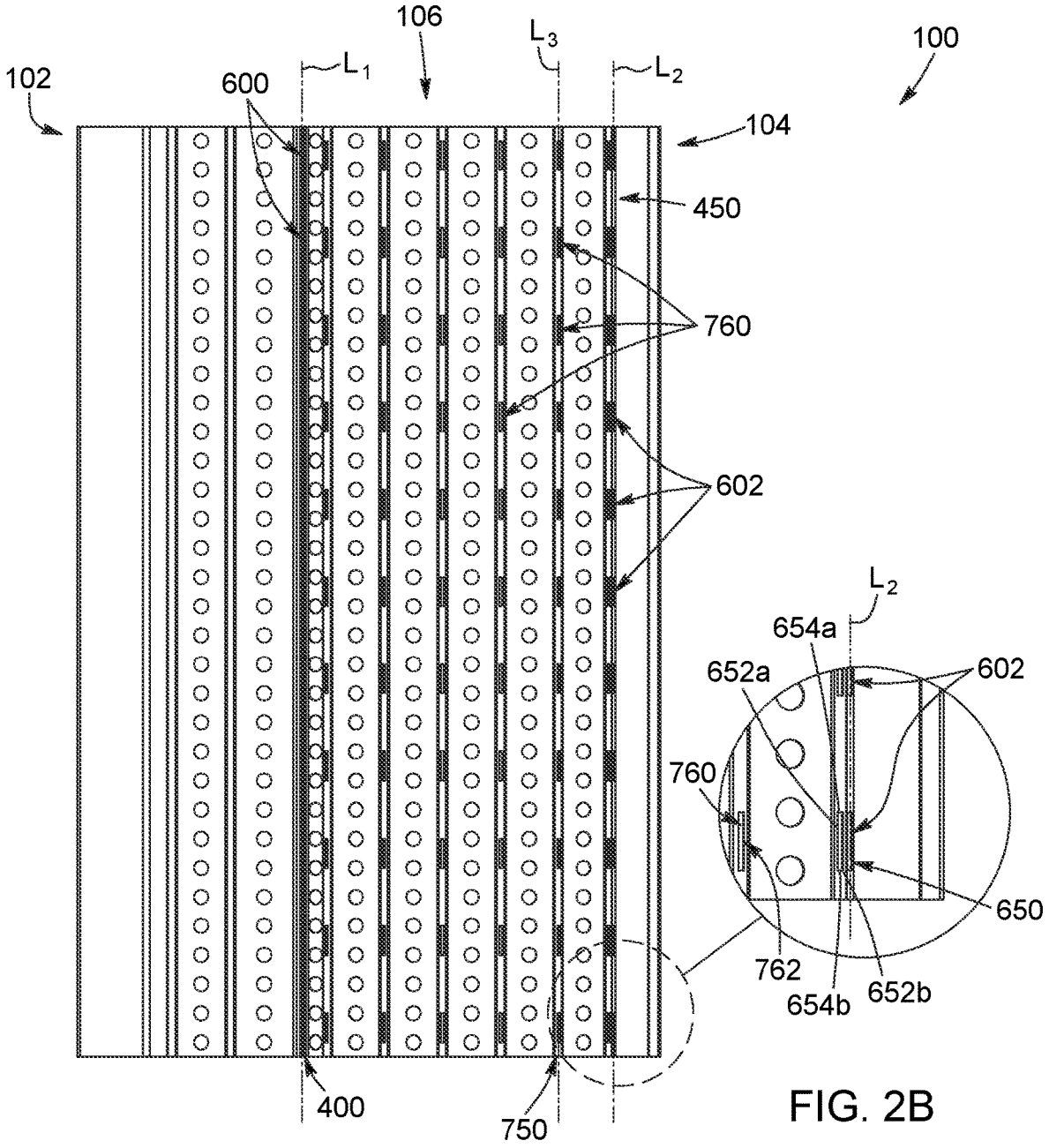
FIG. 2A is a top plan view of the gutter cover illustrated in FIG. 1.
FIG. 2B is an enlarged portion, taken from area A, of the gutter cover illustrated in FIG. 2A.

Specifically, each oblong slit 650 includes a pair of linear side edges 652*a*, 652*b*, best shown in FIG. 2B, which extend parallel to each other and parallel to the longitudinal fold axis $L_1$, $L_2$ of the corresponding connecting fold 400, 450. Still in the illustrated embodiment, each oblong slit 650 is substantially rectangular in shape and further includes a pair of linear end edges 654*a*, 654*b* which extends parallel to each other and perpendicular to the longitudinal fold axis $L_1$, $L_2$ of the corresponding connecting fold 400, 450. Alternatively, the oblong slits 650 could be substantially obround instead of rectangular and could include rounded edges instead of the linear end edges 654*a*, 654*b*. In another embodiment, the oblong slit 650 may not include linear side edges 652*a*, 652*b* and could instead be oval-shaped, diamond-shaped or have any other suitable shape.

In one embodiment, each oblong slit 650 has a length of between about 1/16 inch and about 7 inches, or more specifically, a length of about 1/4 inch. Alternatively, the oblong slits 650 could have a different length.

In the illustrated embodiment, the fold openings 600, 602 are substantially evenly spaced apart from each other along the corresponding connecting fold 400, 450. In one embodiment, the fold openings 600, 602 are spaced from each other by a distance of between about 1/8 inch and about 2 inches, or more specifically, by a distance of about 1/2 inch. Alternatively, instead of being evenly spaced from each other, the distance between adjacent fold openings 600, 602 may vary along the corresponding connecting fold 400, 450.

It will be understood that the sum of the length of the fold openings 600, 602 can further be easily expressed as a percentage of a total length of the gutter cover 100. In other words, this percentage corresponds to the amount of material that has been removed from the gutter cover 100 to form the fold openings 600, 602. For example, in one embodiment, the fold openings 600, 602 could extend over between about 5% and 90% of a length of the gutter cover 100. Specifically, the fold openings 600, 602 could extend over between about 25% and 50% of the length of the gutter cover 100, and more specifically could extend over about 33% of the length of the gutter cover 100.

Still referring to FIGS. 1 to 3C, in the illustrated embodiment, the rear cover section 300 is defined by a plurality of planar panel portions 700 which extend in the lengthwise direction relative to the gutter cover 100. Each panel portion 700*a* is slightly angled relative to an adjacent panel portion 700*b* to define a rear section fold 750 between the adjacent panel portions 700*a*, 700*b*. In this configuration, all the panel portions 700 together define a substantial curvature of the rear cover section 300. In the illustrated embodiment, the rear cover section 300 includes five rear section folds 750 and six panel portions 700. Alternatively, the rear cover section 300 could include more or less than six panel portions 700 and more or less than five rear section folds 750. For example, the rear cover section 300 could include between two and ten rear section folds 750, or could even include more than ten rear fold section folds 750. It will be appreciated that the curvature of the rear cover section 300 will be smoother if a greater number of panel portions 700 are used.

In the illustrated embodiment, each throughhole row 152 extends along a corresponding panel portion 700 in a lengthwise direction relative to the gutter cover 100. Alternatively, the drainage throughholes 150 may be disposed according to another arrangement or pattern in the rear cover section 300.

In the illustrated embodiment, each rear section fold 750 has a substantially V-shaped cross-section and includes a front panel portion 752 located towards the front cover section 200 and a rear panel portion 754 located towards the rear cover section 300. The front and rear panel portions 752, 754 are angled relative to each other and meet each other to form a fold ridge 756. The fold ridge 456 is substantially linear and extends in the lengthwise direction relative to the gutter cover 100 along a longitudinal fold axis $L_3$ of the rear section fold 750.

In the illustrated embodiment, when the gutter cover 100 is installed on the gutter 50, the rear section folds 750 extend upwardly and away from the gutter 50, unlike the section connecting fold 400 and the rear connecting fold 450. In other words, when the gutter cover 100 is installed on the gutter 50, the fold ridge 756 of the rear section folds 750 is located above the central cover portion 106. Alternatively, the rear section folds 750 could instead extend downwardly and towards the gutter 50. In yet another embodiment, one or more of the rear section folds 750 could extend upwardly and one or more of the rear section folds 750 could extend downwardly.

In this embodiment, the rear cover section 300 further includes a plurality of rear fold openings 760 located along the rear section folds 750. Similarly to the connecting fold openings 600, 602 defined in the section connecting fold 400 and the rear connecting fold 450, the rear fold openings 760 reduce the amount of material along the rear section folds 750 in order to increase the flexibility of the rear cover section 300 along the rear section folds 750. This increase in flexibility may facilitate the shaping of the rear cover section 300 in a substantially curved configuration.

In the illustrated embodiment, the rear fold openings 760 are substantially similar to the fold openings 600 defined in the section connecting fold 400. Specifically, all the rear fold openings 760 are similar to each other and each rear fold opening 760 includes an elongated or oblong slit 762 which extends along a corresponding rear section fold 750. Still in the illustrated embodiment, the fold openings 760 are all similarly shaped but alternatively, the fold openings 760 could have different shapes from each other. In one embodiment, each oblong slit 762 has a length of between about 1/16 inch and 7 inches, or more specifically, a length of about 1/4 inch. Alternatively, the oblong slits 762 could have a different length.

In the illustrated embodiment, all the oblong slits 762 on a common rear section fold 750 are spaced evenly apart from each other. In one embodiment, the fold openings 762 are spaced from each other by a distance of between about 1/8 inch and 2 inches, or more specifically, by a distance of about 1/2 inch.

In another embodiment, instead of including oblong slits, the fold openings 760 could be obround, oval, elliptical, diamond-shaped or have any other suitable shape. Moreover, instead of being evenly spaced from each other, the distance between adjacent fold openings 760 may vary along the rear section fold 750.

It will be understood that the gutter cover 100 is not limited to the features described above and could include additional features. For example, in the illustrated embodiment, the gutter cover 100 further includes a plurality of front section folds 800 defined in the front cover section 200 and extending in a lengthwise direction relative to the gutter cover 100. In this embodiment, the gutter cover 100 does not include any fold openings located along the front section folds 800. Alternatively, front fold openings could be defined along the front section folds 800. In other embodiments, the gutter cover 100 could include additional folds in which fold openings are provided to increase the flexibility of the gutter cover 100 along the folds.

In one embodiment, there is further provided a gutter cover blank sheet, not shown, for forming the gutter cover 100. The gutter cover blank sheet could be made of a metal such as aluminium or an aluminium alloy, or from any other suitable metal or material. Initially, the gutter cover blank sheet could be substantially planar. In one embodiment, the gutter cover blank sheet could have a thickness of between about between 0.0115 inch and 0.021 inch.

The gutter cover blank sheet could include a front blank sheet portion for forming the front mounting portion 102 of the gutter cover 100, a rear blank sheet portion for forming the rear mounting portion 104 of the gutter cover and a central blank sheet portion extending between the front and rear blank sheet portions. The central blank sheet portion could substantially correspond to the central cover portion 106 of the gutter cover 100 and could include the plurality of drainage throughholes 150. The central blank sheet portion could further be foldable along the longitudinal fold axes $L_1$, $L_2$, $L_3$ to define the folds 400, 450, 750 of the gutter cover 100. In this embodiment, the central blank sheet portion could further include the fold openings 600, 602 and/or 752 located along the longitudinal fold axes $L_1$, $L_2$ and/or $L_3$ to facilitate folding the central blank sheet portion along the longitudinal fold axes $L_1$, $L_2$ and/or $L_3$. The fold openings 600, 602, 752 could be formed in the central blank sheet portion by punching or any other suitable opening forming technique.

To form the gutter cover 100 using this gutter cover blank sheet, one would simply need to fold the gutter cover blank sheet along the longitudinal fold axes $L_1$, $L_2$ and/or $L_3$ to form the folds 400, 450 and/or 750. The front and rear blank sheet portions could further be suitably folded or bent to form the front and rear cover mounting portions 102, 104.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A gutter cover for covering an open top of a gutter having a front wall, a rear wall and a bottom wall defining a gutter channel, the gutter cover comprising:

a front mounting portion operatively engageable with the front wall of the gutter;

a rear mounting portion operatively engageable with the rear wall of the gutter;

a central cover portion extending between the front and rear mounting portions, the central cover portion having a plurality of drainage throughholes defined therein for allowing liquids to enter the gutter channel, the central cover portion including at least two folds extending in a lengthwise direction of the gutter cover along a longitudinal fold axis, a planar panel extending in the lengthwise direction between adjacent ones of the at least two folds, and a plurality of fold openings spaced apart from each other and located along the at least two folds to increase flexibility of the central cover portion along the at least two folds in order to facilitate bending of the central cover portion along the at least two folds, wherein each one of the at least two folds includes a front panel portion located towards the front mounting portion and a rear panel portion located towards the rear mounting portion, the front and rear panel portions being angled relative to each other and meeting each other to form a fold ridge and a substantially V-shaped cross-section, the fold openings being shaped as elongated slits, extending longitudinally along the fold ridge, and having a different shape than the drainage throughholes.

2. The gutter cover as claimed in claim 1, wherein the fold openings are substantially evenly spaced apart from each other.

3. The gutter cover as claimed in claim 2, wherein the fold openings are spaced from each other by a distance of between about ⅛ inch and about 2 inches.

4. The gutter cover as claimed in claim 3, wherein the fold openings are spaced from each other by a distance of about ½ inch.

5. The gutter cover as claimed in claim 1, wherein all the fold openings are similarly sized and shaped.

6. The gutter cover as claimed in claim 5, wherein each fold opening is substantially rectangular in shape.

7. The gutter cover as claimed in claim 1, wherein each fold opening has a length extending along the longitudinal fold axis and a width extending transversely relative to the longitudinal fold axis, the length being substantially greater than the width.

8. The gutter cover as claimed in claim 7, the length of each fold opening is between about 1/16 inch and about 7 inches.

9. The gutter cover as claimed in claim 8, wherein the length of each fold opening is about ¼ inch.

10. The gutter cover as claimed in claim 7, wherein the width of each fold opening is between about 0.01 inch and about ¼ inch.

11. The gutter cover as claimed in claim 10, wherein the width of each fold opening is about 0.025 inch.

12. The gutter cover as claimed in claim 1, wherein the fold openings extend over between about 33% of the length of the gutter cover.

13. The gutter cover as claimed in claim 1, wherein the central portion includes a plurality of cover sections extending in the lengthwise direction and extending non-parallel to each other.

14. The gutter cover as claimed in claim 13, wherein the plurality of cover sections includes a front cover section located adjacent the front mounting portion and a rear cover section extending in a widthwise direction relative to the gutter between the front cover section and the rear mounting portion.

15. The gutter cover as claimed in claim 14, wherein the at least two folds includes a section connecting fold extending between the front and rear cover sections.

16. The gutter cover as claimed in claim 15, wherein when the gutter cover is installed on the gutter, the section connecting fold extends downwardly and towards the gutter.

17. The gutter cover as claimed in claim 14, wherein the rear cover section is substantially curved.

18. The gutter cover as claimed in claim 14, wherein the at least two folds includes a plurality of rear section folds defined in the rear cover section.

19. The gutter cover as claimed in claim 18, wherein the rear cover section includes a plurality of the planar panel extending in the lengthwise direction, each one of the planar panels being angled relative to adjacent planar panels.

20. The gutter cover as claimed in claim 1, wherein the front mounting portion, the rear mounting portion and the central cover portion are integrally formed together using a single, continuous sheet of material.

21. A gutter cover blank sheet for forming a gutter cover, the gutter cover being installable on a gutter having a front wall, a rear wall and a bottom wall defining a gutter channel the gutter cover blank sheet comprising:

a front blank sheet portion for forming a front mounting portion operatively engageable with the front wall of the gutter;

a rear blank sheet portion for forming a rear mounting portion operatively engageable with the rear wall of the gutter;

a central blank sheet portion extending between the front and rear blank sheet portions, the central blank sheet portion including a plurality of drainage throughholes defined therein, the central blank sheet portion being foldable along at least two longitudinal fold axes to define at least two folds of the gutter cover, each of the at least two folds including a front panel portion located towards the front mounting portion and a rear panel portion located towards the rear mounting portion, the front and rear panel portions being angled relative to each other and meeting each other to form a fold ridge and a substantially V-shaped cross-section, a planar panel extending in a lengthwise direction between adjacent ones of the at least two folds, the central blank sheet portion further including a plurality of fold openings shaped as elongated slits, spaced apart from each other and located along the fold ridge to facilitate folding the central blank sheet portion along the at least one longitudinal fold axis, the fold openings having a different shape than the drainage throughholes.

22. A method for forming a gutter cover, the method comprising:

providing a gutter cover blank sheet as defined in claim 21;

folding the gutter cover blank sheet along the at least one longitudinal fold axis to form the fold in the gutter cover.

23. A gutter assembly comprising:

a gutter having a front wall, a rear wall and a bottom wall defining a gutter channel having an open top;

a gutter cover for covering the open top of the gutter, the gutter cover comprising:

a front mounting portion operatively engageable with the front wall of the gutter;

a rear mounting portion operatively engageable with the rear wall of the gutter;

a central cover portion extending between the front and rear mounting portions, the central cover portion having a plurality of drainage throughholes defined therein for allowing liquids to enter the gutter channel, the central cover portion including at least two folds extending in a lengthwise direction of the gutter cover along a longitudinal fold axis, a planar panel extending in the lengthwise direction between adjacent ones of the at least two folds, and a plurality of fold openings spaced apart from each other and located along the at least two folds to increase flexibility of the central cover portion along the at least two folds in order to facilitate bending of the central cover portion along the at least two folds, wherein each one of the at least two folds includes a front panel portion located towards the front mounting portion and a rear panel portion located towards the rear mounting portion, the front and rear panel portions being angled relative to each other and meeting each other to form a fold ridge and a substantially V-shaped cross section, the fold openings being shaped as elongated slits, extending longitudinally along the fold ridge, and having a different shape than the drainage throughholes.

* * * * *